US007021964B1

(12) United States Patent
Croan

(10) Patent No.: US 7,021,964 B1
(45) Date of Patent: Apr. 4, 2006

(54) RJ "F", MODULAR CONNECTOR FOR COAXIAL CABLES

(76) Inventor: Quinn F. Croan, 5533 E. Pinchot Ave., Phoenix, AZ (US) 85018

( * ) Notice: Subject to any disclaimer, the term of this patent is extended or adjusted under 35 U.S.C. 154(b) by 0 days.

(21) Appl. No.: 11/163,200

(22) Filed: Oct. 10, 2005

Related U.S. Application Data

(63) Continuation of application No. 10/906,192, filed on Feb. 8, 2005, now Pat. No. 6,955,563.

(51) Int. Cl.
*H01R 9/05* (2006.01)

(52) U.S. Cl. ..... 439/578

(58) Field of Classification Search ..... 439/578, 439/583

See application file for complete search history.

(56) References Cited

U.S. PATENT DOCUMENTS

| | | | | | |
|---|---|---|---|---|---|
| 3,355,698 | A * | 11/1967 | Keller | ..... | 439/421 |
| 3,363,222 | A * | 1/1968 | Karol | ..... | 439/581 |
| 4,400,050 | A * | 8/1983 | Hayward | ..... | 439/585 |
| 4,553,806 | A * | 11/1985 | Forney et al. | ..... | 439/585 |
| 4,668,043 | A * | 5/1987 | Saba et al. | ..... | 439/585 |
| 4,684,201 | A * | 8/1987 | Hutter | ..... | 439/585 |
| 4,755,152 | A * | 7/1988 | Elliot et al. | ..... | 439/452 |
| 4,806,116 | A * | 2/1989 | Ackerman | ..... | 439/578 |
| 5,073,129 | A * | 12/1991 | Szegda | ..... | 439/585 |
| 6,168,455 | B1 * | 1/2001 | Hussaini | ..... | 439/584 |
| 6,290,538 | B1 * | 9/2001 | Pocrass | ..... | 439/578 |

* cited by examiner

*Primary Examiner*—Briggitte R. Hammond

(57) ABSTRACT

A connector employing a plug assembly and socket assembly for coaxial cables having apertures, conductive elements, mating surfaces and locking mechanisms to maintain the electrical characteristics of the cable joined to the plug and socket, to hold the plug and socket physically in connection with one another, and to establish and maintain the electrical characteristics of the cables through the connector. The plug is configured to attach to a coaxial cable in such a manner that: a) the center conductor of the coaxial cable extends through the plug assembly for engagement with mating conductors in the socket, and b) such that the shield of the cable is physically and electrically engaged by a conductive element extending through the plug which contacts the conductive elements within the socket. These two features establish electrical contact of the shield and center conductor into and through the connector. The connector includes a socket assembly having a receiving aperture formed therein for receiving the plug assembly. The socket assembly is configured to accept a second coaxial cable for electrically contacting the first coaxial cable when the plug is received in the receiving aperture, or, in the modified form, for connecting the first coaxial cable to terminal equipment, or, in the second modified form for adapting a standard male threaded connector to a socket assembly, or in the third modified form for adapting a standard female threaded connector to a plug assembly. The socket assembly includes an outer conductor element that is electrically isolated from inner conductive elements of the socket assembly that provide electrical continuity for the inner conductor of the cables. The connector assembly incorporates a compressible conductive element placed at the junction of the outer conductors of the plug and socket. The outer conductor and inner conductor of the plug assembly and socket assembly are electrically connected when the plug is received in the receiving aperture. The plug and socket assemblies incorporate a snap-fit, locking mechanism to retain the plug and socket assemblies in mechanical and electrical connection with each other.

8 Claims, 8 Drawing Sheets

RJ "F", MODULAR CONNECTOR FOR COAXIAL CABLES

BACKGROUND OF THE INVENTION

This invention relates to fittings for connecting coaxial cables together, to connecting coaxial cables to terminal devices and to adapters for converting cables with traditional connectors for use with this improved connector. This invention further relates to improvements in the electrical characteristics and mating characteristics of end connectors in RJ type modular connectors as used for establishing and maintaining a mechanical and electrical connection in a modular arrangement that incorporates a locking mechanism.

Coaxial cables are generally characterized by being made up of inner and outer concentric conductors (or center conductor and shield respectively) separated by a dielectric insulator, with some cables being encased or covered by a protective outer jacket of rubber or rubber-like material. Numerous types of end connectors have been devised to effect a secure mechanical and electrical connection to the end of the coaxial cable, which provide for connecting coaxial cables to other coaxial cables, and for connecting coaxial cables to various terminal devices while maintaining the electrical characteristics of the cable or cables.

The current invention provides further refinements to my earlier invention, patent application Ser. No. 10/906,192 filed Feb. 8, 2005 for RJ TYPE MODULAR CONNECTOR FOR COAXIAL CABLES, now U.S. Pat. No. 6,955,563 issued on Oct. 18, 2005.

Prior art coaxial connectors as invented by Croan include a plug and socket arrangement using conductive sleeves, one having a tapered cone and the other having a complementary tapered counterbore, with one conductive sleeve being longitudinally movable within its respective plug or socket body, such movable element being tensioned to maintain connectivity between said tapered cone and tapered counterbore, thereby establishing an electrical path for the outer conductors of the coaxial cable when plug and socket are mated together. The conductive path for the center conductors of coaxial cables is established through a conductive element employing conductive prongs. This modular type connector includes a socket assembly having a mating cavity configured to accept and mate with external guide surfaces of a plug assembly guiding the conductive elements into proper alignment for mating and effecting mechanical engagement and electrical conductivity of inner and outer conductors.

A problem with Croan's prior modular type coaxial connector is in providing the requisite electrical path across the junction of the tapered cone and tapered counterbore. Maintaining the electrical characteristics of the cable through the connector requires the surfaces of these elements to be machined with a high degree of precision, with the likely outcome of increasing the costs of manufacturing such connectors. In the absence of requisitely precise machining, the conductive and shielding properties of the outer conductor of the connector are reduced.

A further problem with Croan's modular connector lies in the complexity and manufacturing cost that is added through using a longitudinally movable conductive sleeve that is tensioned to maintain said conductive sleeves in contact with one another in either the socket or the plug assembly.

Yet a further problem in Croan's modular connector, one shared with many other types of connectors for coaxial cables, arises from using conductive prongs to effect electrical connectivity between the connector and the center conductor of the cable. These prongs arrangements tend to provide a lower quality of electrical connection that over time degrades the transmission path such that the transmitted signals are partially reflected, and/or otherwise impaired.

It is, therefore, an object of the present invention to overcome the above problems and others by providing a coaxial cable connector which can be easily connected directly to a cable, and that provides a removable connection between a pair of coaxial cables, or between a coaxial cable and a terminal device while sustaining electromagnetic shielding of a signal conveyed within the coaxial cable(s). Still other objectives of the present invention will become apparent to those of ordinary skill in the art upon reading and understanding the following detailed description.

SUMMARY OF INVENTION

Accordingly, I have invented a novel and improved modular connector for positively splicing cables together, connecting cables at wall plates, connecting coaxial cables to terminal equipment, and adapting traditional connectors to a modular plug and socket arrangement.

The objective of the present invention is to provide a plug assembly that attaches directly to the prepared end of a coaxial cable, which is used in conjunction with a socket assembly that employs a snap-fit, locking mechanism for maintaining said plug and socket assemblies in mechanical and electrical connection when mated together.

It is another object of the present invention to provide for a plug assembly and socket assembly wherein the plug and socket conductive sleeves of each assembly are generally fixed within their respective plug and socket bodies'.

It is another objective of the present invention that the connector assembly herein proposed be capable of effecting sealed engagement with one end of a coaxial cable and of being interchangeable for use with coaxial cables of different sizes and/or different impedances.

It is the further object of the present invention to provide a plug and socket with improved electrical transmission characteristics of the center conductive elements.

It is the further object of the present invention to provide a plug and socket with improved conductive properties of the outer conductor across the connector.

It is yet another object of the present invention to provide for a connector adapter assembly for coaxial cables that will adapt cables or devices having traditional threaded connectors for use with the modular plug and socket arrangement utilizing the snap-fit, locking mechanism features of this invention.

In accordance with the present invention, a modular connector assembly has been devised for connecting an end of a coaxial cable to a plug and/or socket wherein the cable is a standard cable having radially inner and outer generally cylindrical conductors separated by an annular dielectric, and in some cases, an outer tubular jacket of rubber or rubber-like material encasing the outer conductor and with a portion of both the inner and the outer conductor being exposed at the end of the cable.

Due to the wide variety of cables, cable types and cable sizes, and the vast number of mechanisms used to secure a connector to such cables, any of which may be employed with the novel elements of this invention, only one mechanism for securing a cable to the novel elements of this invention will be depicted herein. However, this limited depiction is herein used to simplify review of the novel elements of my invention and is not intended to restrict or limit the use of other mechanisms for securing a cable to the novel elements of this invention.

The plug is comprised of radially inner and outer spaced conductors wherein the inner conductor is formed by the center conductor of the coaxial cable and extends through a conductive sleeve, this sleeve being sized for insertion of the outer conductor and jacket, if any, through one end of the connector between the inner and outer sleeves, engaging an external surface of the jacket only when the cable is fully inserted into the connector and the outer sleeve is deformed radially inwardly until the effecting sealed engagement with the jacket, and a socket connector is complementary to the plug connector for connecting the cable to the socket. The conductive sleeve of the plug may be mounted into a dielectric casing that is formed so as to provide the retaining mechanism for the plug and to provide for physical mating with a complementary socket aperture. Alternatively, the plug may be a single piece formed of conductive material, or a single piece formed of a dielectric material with conductive material deposited on appropriate surfaces. The conductive sleeve may include a compressible conductive element that is positioned around the tapered cone of the conductive sleeve and may be permanently or semi-permanently attached thereto. Alternatively, the compressible conductive element may be positioned in the socket assembly as described below.

The socket is comprised of radially inner and outer spaced conductors wherein the inner conductor is formed by the center conductor of the coaxial cable and extends into the socket connector and is brought into engagement with a receiving bore of the central conductive element in the body of the socket that connects physically and electrically to a second receiving bore that is positioned for engagement with the center conductor of the plug connector when plug and socket are mated together. A conductive sleeve within the socket is sized for insertion of the outer conductor through one end of the connector between the inner and outer sleeves, the outer sleeve engaging an external surface of the jacket only when the cable is fully inserted into the connector and the outer sleeve is deformed radially inwardly, and a plug connector is complementary to the socket connector for connecting the cable to the plug. The conductive sleeve of the socket may be mounted into a dielectric casing that is formed so as to provide the complementary retaining mechanism and aperture for receiving the plug and to provide for physical mating with the complementary plug. Alternatively, the socket may be a single piece formed of conductive material, or a single piece formed of a dielectric material with conductive material deposited on appropriate surfaces. The socket conductive sleeve may include a compressible conductive element that is positioned within the tapered counterbore of the conductive sleeve and may be permanently or semi-permanently attached thereto. Alternatively, the compressible conductive element may be positioned in the plug assembly as described above.

In preferred and modified forms of the invention, any of a variety of methods may be used to effect sealed engagement between the cable and the plug assembly or socket assembly. The method shown in preferred and modified forms of the invention is not a novel aspect of the current invention, neither is it the only method, consistent with the state of the art, for attaching the plug and/or socket to the end of a cable, and does not in any way limit or restrict using the novel aspects of the current invention with other methods of attachment.

The terminal connector has a socket that serves to facilitate connection of the plug end connector to a terminal. The terminal connector employs a socket assembly suitable for insertion of a plug assembly, while further providing points of attachment to the inner and outer conductors of the socket assembly for connection to the electrical circuitry of the terminal.

The terminal and cable adaptors have either a socket or a plug with a threaded connection to facilitate attachment of a plug or socket end connector to a terminal, device or cable. The terminal adaptor employs a threaded female connection that threadedly mates to a standard male threaded connector, while providing either a socket assembly or a plug assembly suitable for mating with a complementary socket or a plug assembly, with the threaded portions providing a connection for the outer conductor and provision made for extending the center conductor to effect a connection within the male terminal connector. The cable adaptor employs a threaded male connection that threadedly mates to a standard female threaded connector, while providing either a socket assembly or a plug assembly suitable for mating with a complementary socket or a plug assembly, with the threaded portions providing a connection for the outer conductor and provision made for receiving the center conductor to effect a connection within the female cable adaptor.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
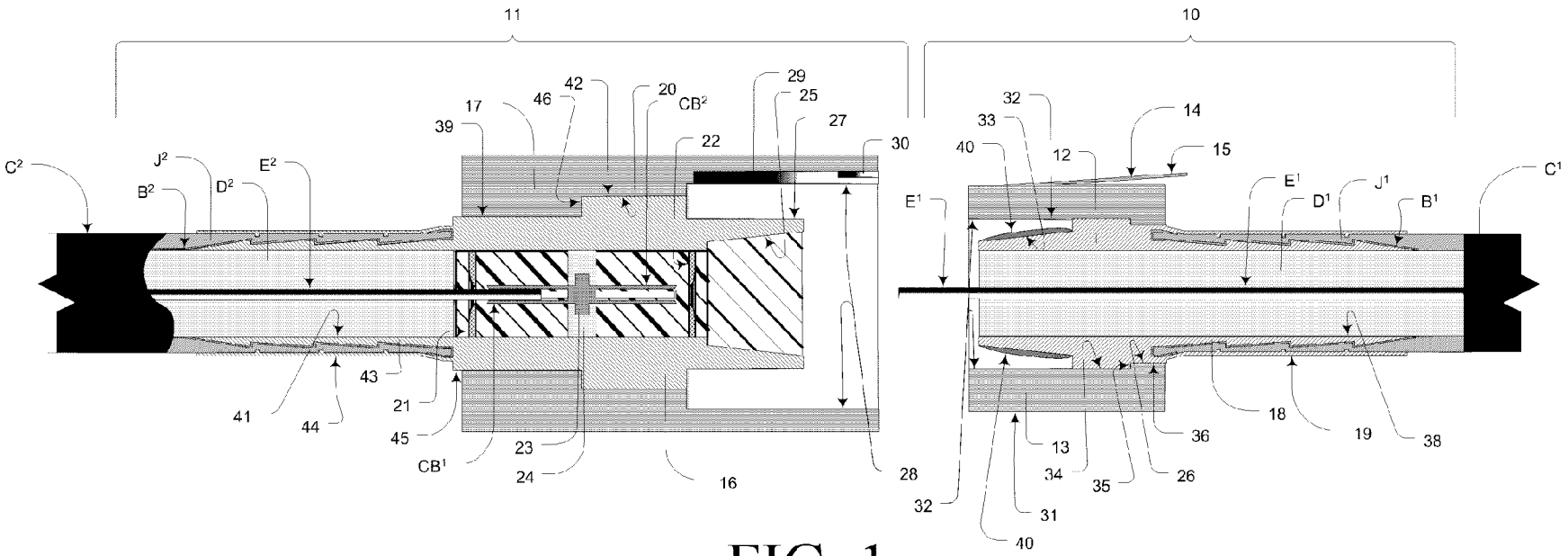
FIG. 1 is a longitudinal cross-sectional view illustrating one preferred form of the invention for interconnecting two cables with the parts fully assembled on two coaxial cables, with plug and socket assemblies unmated.
Figure 2A:
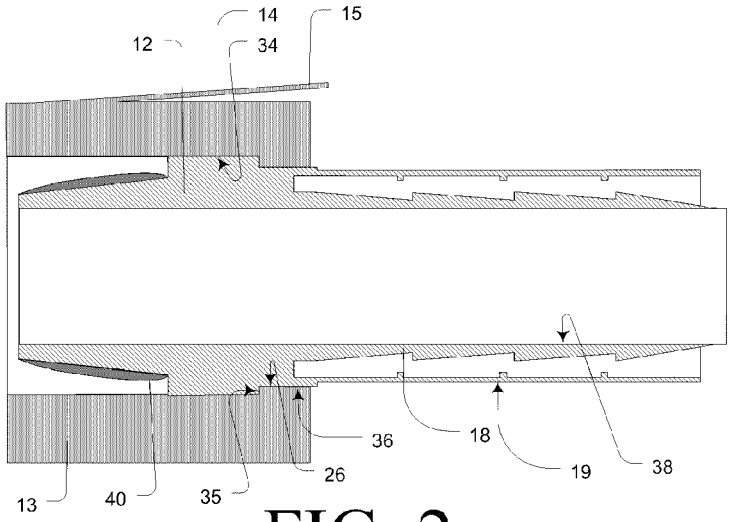
FIG. 2*a* is a longitudinal cross-sectional view of the invention shown in FIG. 1, but here showing the plug assembly without a cable inserted.
Figure 2B:
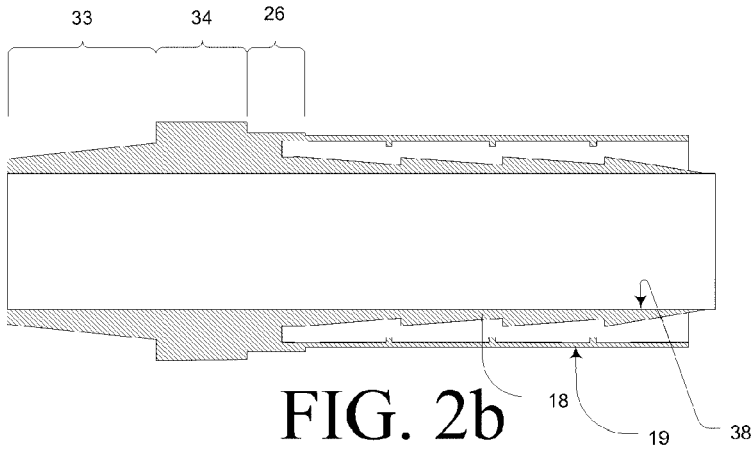
FIG. 2*b* is a longitudinal cross-sectional view of the of the invention shown in FIG. 1, but here showing only the conductive sleeve of the plug assembly.
Figure 2C:
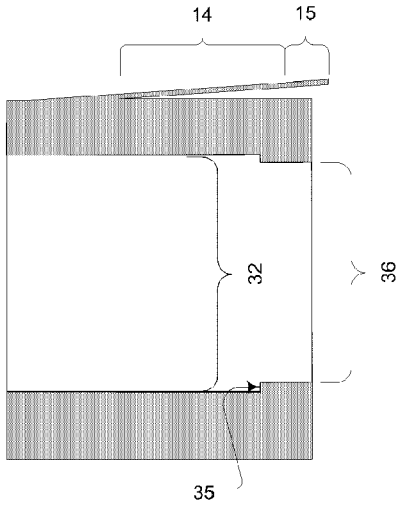
FIG. 2*c*, is another longitudinal sectional view on the invention shown in FIG. 1, but showing only the body of the plug assembly.
Figure 3A:
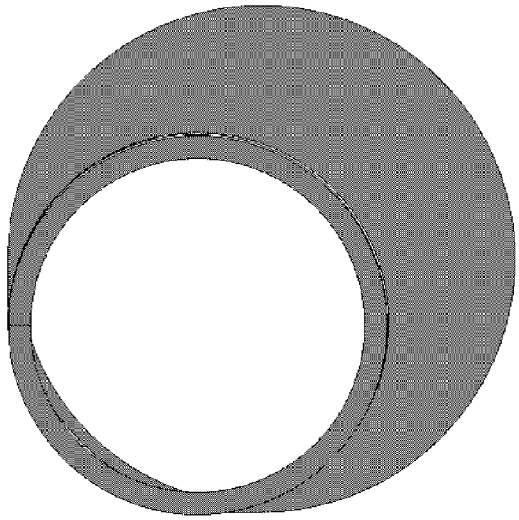
FIG. 3*a* is a perspective view showing one form of the compressible conductive element of the invention shown in FIG. 1.
Figure 3B:
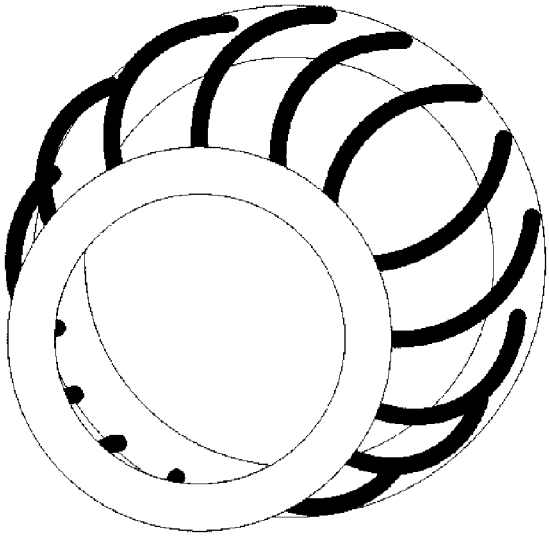
FIG. 3*b* is a perspective view showing a second form of the compressible conductive element of the invention shown in FIG. 1.
Figure 4A:
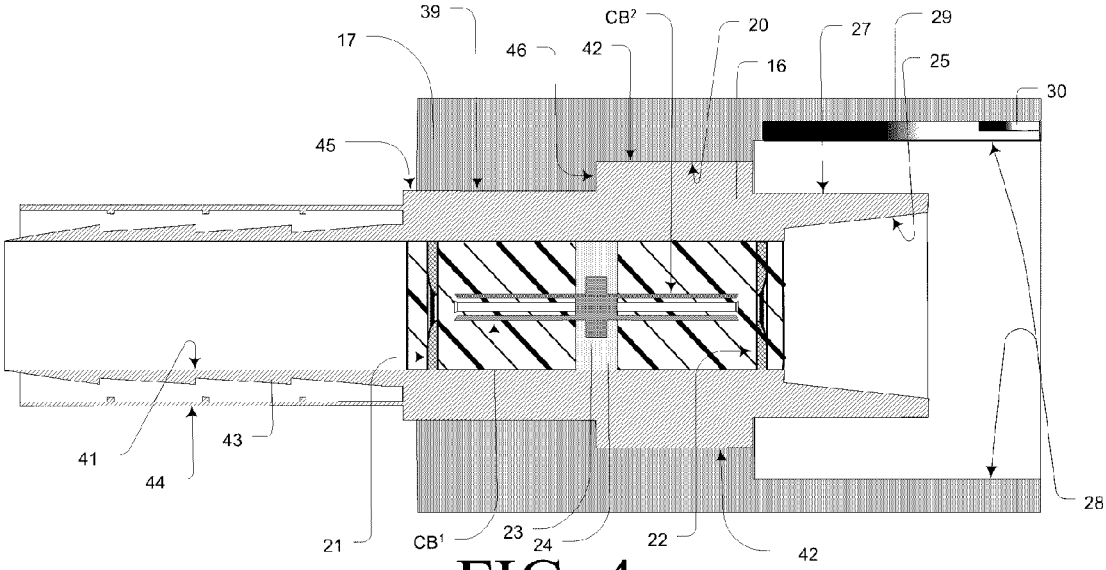
FIG. 4*a* is another longitudinal sectional of the socket assembly of the invention shown in FIG. 1, but here shown without a cable inserted.
Figure 4B:
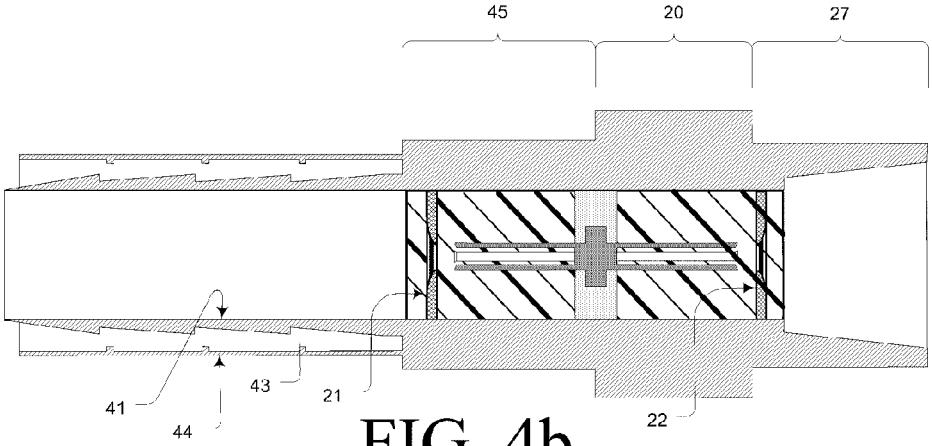
FIG. 4*b*, is another longitudinal sectional view on the invention shown in FIG. 1, but showing only the conductive sleeve of the socket assembly.
Figure 4C:
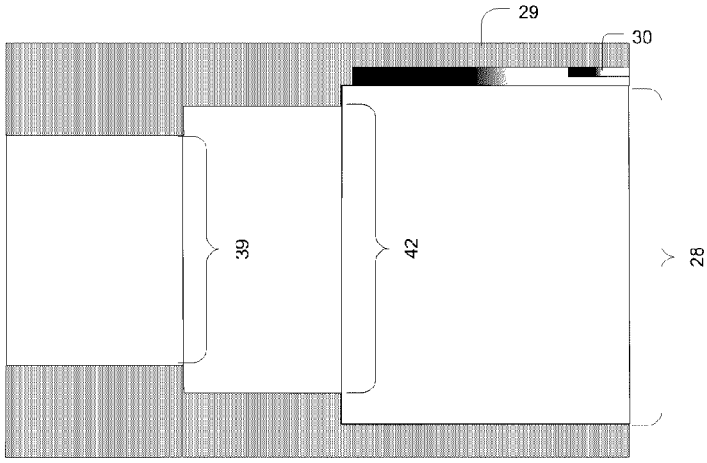
FIG. 4*c* is another longitudinal sectional view on the invention shown in FIG. 1, but here showing only the body of the socket assembly.
Figure 5A:
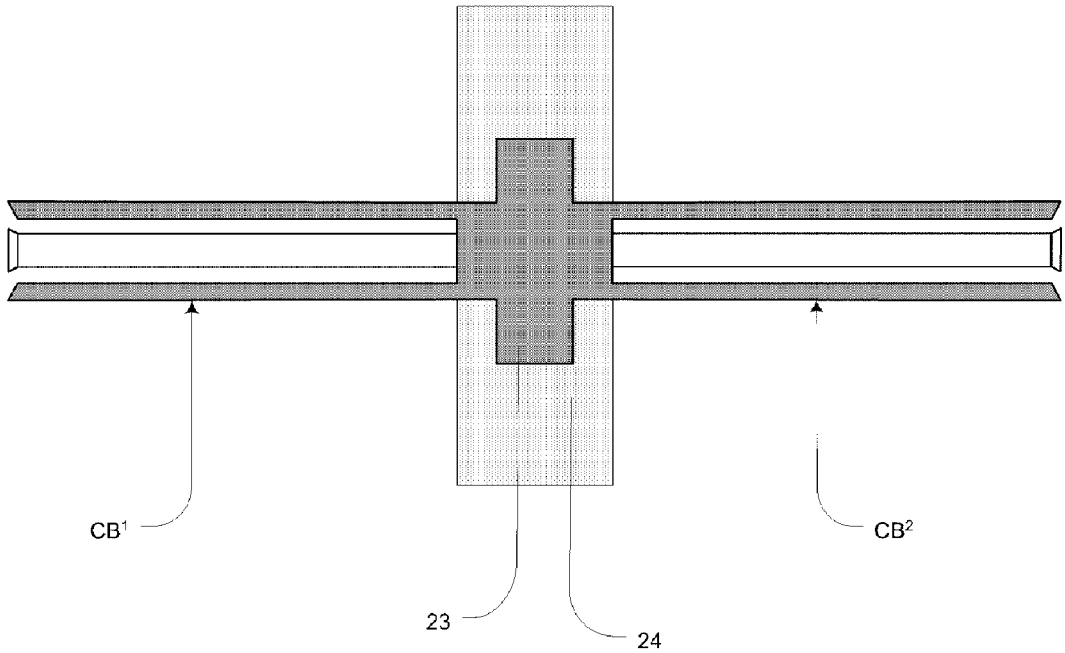
FIG. 5*a* is another longitudinal sectional view of the invention shown in FIG. 1, but here showing only the center conductive element with the dielectric support of the socket assembly.
Figure 5B:
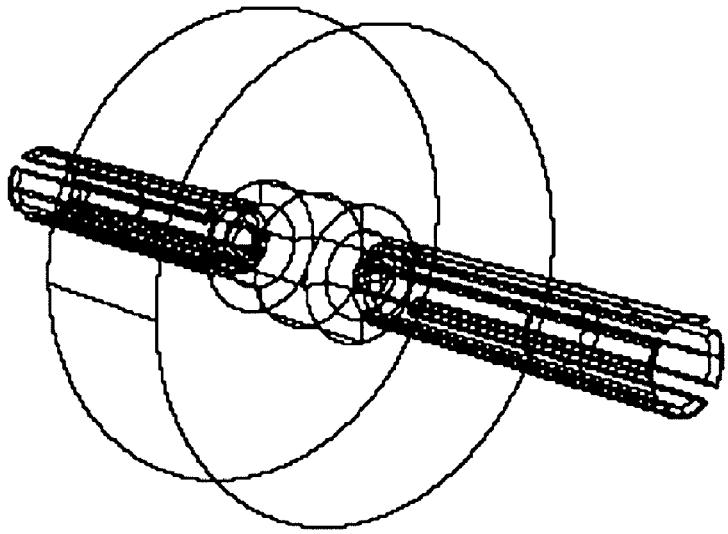
FIG. 5*b* is perspective view of the center conductive element of the socket assembly with the dielectric support of the socket assembly of the invention shown in FIG. 1.

Referring in more detail to the drawings, there is shown by way of illustrative example in FIGS. 1, 2*a*, 2*b*, 2*c*, 3*a*, 3*b*, 4*a*, 4*b*, 4*c*, 5*a* and 5*b* a plug assembly 10 and socket assembly 11 for positively interconnecting conventional forms of coaxial cables $C^1$ and $C^2$. As a setting for the present invention, inner and outer sleeves, 18 and 19 of plug assembly 10, and 43 and 44 of socket assembly 11, are of a type employed in existing screw type and push type connectors, and form the components of said connectors that capture a coaxial cable in the connector for illustrative purposes only. These are shown in the preferred form of the invention as only one viable method of directly connecting the novel portions of the invention directly to a cable, which, by providing for direct connection to the plug assembly and/or socket assembly, is, in and of itself, a novel element of the current invention.

The plug assembly 10 is broadly comprised of a plug body 13, having a locking tab 14 with release tab 15, with bore 32 and bore 36 into which plug conductive sleeve 12 is inserted. Plug assembly 10 is further comprised of plug conductive sleeve 12 having a central bore 38, tapered cone 33, cylindrical element 34, cylindrical element 26, inner sleeve 18 and outer sleeve 19. Plug conductive sleeve 12 is inserted into plug body 13 through bore 32 and 36, which are sized and shaped complimentary to cylindrical elements 34 and 26 such that when conductive sleeve 12 is fully seated in plug body 13, cylindrical element 34 rests against shoulder 35.

Plug body 13 has external outer surface(s) 31 that are complimentary to the internal guiding surface(s) 28 of socket body 17 (which surfaces for both plug and socket while depicted with, are not restricted to four) providing mechanical alignment of plug to socket. When plug assembly 10 is inserted in to socket body 17, locking tab 14 is flexed downward to permit insertion, and when fully inserted into socket body 17, locking tab 14 flexes upward returning to its resting position, engaging socket locking cavity 29 such that plug assembly 10 remains in engagement with socket assembly 11 and cannot be withdrawn. Release tab 15 extends outward through locking tab release slot 30 of socket body 17 providing the means of disengaging locking tab 14 from socket locking cavity 29 for un-mating of plug and socket assemblies. Such disengagement is accomplished by depressing release tab 15, which flexes locking tab 14 downward, disengaging it from socket locking cavity 29, thereby permitting withdrawal of plug assembly 10 from socket assembly 11. The plug-mating cavity formed by bore 32 is configured to receive cylindrical element 27 of socket conductive sleeve 16.

Plug conductive sleeve 12 is formed with tapered conductive cone 33 that engages with tapered counterbore 25 of socket conductive sleeve 16 of socket assembly 11 when mated together. Compressible conductive element 40 is placed between tapered conductive cone 33 and tapered counterbore 25 the conductive properties of which enable a conductive path between tapered conductive cone 33 and tapered counterbore 25, and being deformable will compress in a manner that compensates for machining irregularities or other misalignment, thereby ensuring maximum electrical conduction across this junction under all conditions. (Although compressible conductive element 40 is depicted as part of plug assembly 10, the invention encompasses the option of incorporating it into socket assembly 11 by being placed within tapered counterbore 25.) Tapered conductive cone 33 and tapered counterbore 25 when mated together provide, through compressible conductive element 40, a conductive path between plug and socket assemblies 10 and 11, providing continuity between the outer conductors of cables $C^1$ and $C^2$.

As shown in FIGS. 1, 2*a*, 2*b*, 2*c*, 3*a* and 3*b*, plug conductive sleeve 12 has an inner sleeve 18 extending rearward from cylindrical element 26 with reduced diameter and wall thickness in relation to cylindrical element 26, and an outer sleeve 19 extending reward from cylindrical element 26. Inner sleeve 18 and outer sleeve 19 are not novel elements of plug assembly 10 and are only included to illustrate one method of directly capturing and retaining coaxial cable $C^1$ within plug assembly 10 and providing electrical connection between outer conductor $B^1$ of cable $C^1$ and conductive sleeve 12 of plug assembly 10. As such, these particular elements may take on various forms, commensurate with current art, in order to accommodate various cable types, cable sizes and cable impedances.

In accordance with conventional practice, the coaxial cable $C^1$ is made up of an inner conductor $E^1$, a dielectric insulator $D^1$, outer conductor $B^1$ and dielectric jacket $J^1$, the latter being composed of a suitable rubber or rubber-like compound if present. The inner conductor $E^1$ is in the form of a pin that is exposed by removing a limited length of the dielectric insulator $D^1$, and a limited length of the conductor $B^1$ is peeled away from the insulator $D^1$ and doubled over the outer jacket $J^1$.

When cable $C^1$ is inserted into plug conductive sleeve 12, outer conductor $B^1$ is brought into contact with the outer surface of inner sleeve 18 providing electrical connectivity between cable $C^1$ and tapered cone 33 through conductive sleeve 12. The exposed portion of dielectric $D^1$ extends through sleeve 18 to the inner end of plug conductive sleeve 12, with the exposed portion of inner conductor $E^1$ extending there from with sufficient length to pass through insulating guide 22 of socket assembly 11 and come into engagement within slotted counterbore $CB^2$ of central conductive element 23 in socket assembly 11. With cable $C^1$ fully inserted, outer sleeve 19 is compressed radially inward to effect sealed engagement between cable $C^1$ and conductive sleeve 12.

Referring to FIGS. 1, 4*a*, 4*b*, 4*c*, 5*a* and 5*b*, socket assembly 11 is broadly comprised of a socket body 17, with locking cavity 29 with release tab slot 30, and with bore 39 and counterbore 42 into which socket conductive sleeve 16 is inserted. Socket assembly 11 is further comprised of conductive sleeve 16 having a central bore 41, plug-engaging cylinder 27, tapered counterbore 25, cylindrical element 45, cylindrical element 20, inner sleeve 43 and outer sleeve 44. Within socket conductive sleeve 16 are located insulating guide rings 21 and 22, central conductive element 23 with slotted counterbores $CB^1$ and $CB^2$ and dielectric 24 for supporting and insulating central conductive element 23 within conductive sleeve 16. While not depicted as such, compressible conductive element 40 may be placed within tapered counterbore 25 as discussed above.

Socket body 17 has internal surface(s) 28 recessed into one end that are complimentary to the external outer surface(s) 31 of plug body 13 (which surfaces for both plug and socket while depicted with, are not restricted to four), and serve to guide plug assembly 10 into a proper mating position with socket assembly 11. When socket assembly 11 receives plug assembly 10, socket-locking cavity 29 receives locking tab 14 such that plug assembly 10 is held in engagement with socket assembly 11 and cannot be withdrawn. Locking tab release slot 30 provides a channel for release tab 15 to extend outward through socket body 17 providing the means of disengaging locking tab 14 from locking cavity 29. In the fully mated position, locking tab 14 maintains plug assembly 10 within socket assembly 11 against the force exerted by compressible conductive element 40 at the junction between socket conductive sleeve 16 and plug conductive sleeve 12 formed by tapered counterbore 25 and tapered cone 33.

Socket conductive sleeve 16 is formed with plug engaging cylinder 27 that extends into the mating cavity of plug body 13, which cavity is formed by counterbore 32 of plug body 13. Tapered counterbore 25 of socket conductive sleeve 16 engages with tapered conductive cone 33 of plug conductive sleeve 12 when plug and socket assemblies are mated together. Compressible conductive element 40 is placed between tapered counterbore 25 and tapered conductive cone 33 the conductive properties of which enable a conductive path between tapered conductive cone 33 and tapered counterbore 25, and being deformable will compress in a manner that compensates for machining irregularities or other misalignment, thereby ensuring maximum electrical conduction across this junction under all conditions. Tapered counterbore 25 and tapered conductive cone 33 when mated together provide a conductive path through compressible conductive element 40 between plug and socket assemblies 10 and 11, establishing electrical continuity of the outer conductors of cables $C^1$ and $C^2$. Socket conductive sleeve 16 is further formed with cylindrical element 45 and cylindrical element 20 for insertion into bore 39 and counterbore 42 of socket body 13 with cylindrical element 20 resting against shoulder 46 when fully inserted into socket body 17.

As shown in FIGS. 1, 4*a*, 4*b*, 4*c*, 5*a* and 5*b*, socket conductive sleeve 16 has an inner sleeve 43 extending rearward from cylindrical element 45 with reduced diameter and wall thickness in relation to cylindrical element 45, and an outer sleeve 44 extending reward from cylindrical element 45. Inner sleeve 43 and outer sleeve 44 are not novel elements of socket plug assembly 11 and are only included to illustrate one method of capturing and retaining coaxial cable $C^2$ within socket assembly 11 and providing electrical connection between outer conductor $B^2$ of cable $C^2$ and conductive sleeve 16 of socket assembly 11. As such, these particular elements may take on various forms, commensurate with current art, in order to accommodate various cable types, cable sizes and cable impedances.

In accordance with conventional practice, the coaxial cable $C^2$ is made up of an inner conductor $E^2$, a dielectric insulator $D^2$, outer conductor $B^2$ and dielectric jacket $J^2$, the latter being composed of a suitable rubber or rubber-like compound, if present. The inner conductor $E^2$ is in the form of a pin that is exposed by removing a limited length of the dielectric insulator $D^2$, and a limited length of the conductor $B^2$ is peeled away from the insulator $D^2$ and doubled over the outer jacket $J^2$.

When cable $C^2$ is inserted into socket conductive sleeve 16, outer conductor $B^2$ is brought into contact with the outer surface of inner sleeve 43 providing electrical connectivity between cable $C^2$ and tapered counterbore 25 through conductive sleeve 16. The exposed portion of dielectric $D^2$ extends through inner sleeve 43 to a position short of that occupied by insulating guide 21 contained within bore 41 of conductive sleeve 16. The exposed portion of inner conductor $E^2$ extends there from with sufficient length to pass through insulating guide 21 and come into engagement with slotted counterbore $CB^1$ of center conductive element 23 contained within bore 41 of conductive sleeve 16. With cable $C^2$ fully inserted, outer sleeve 19 is compressed radially inward to effect sealed engagement between cable $C^2$ and conductive sleeve 16.

Within central bore 41 of conductive sleeve 16, slotted counterbore $CB^1$ forms one end of conductive element 23 with slotted counterbore $CB^2$ forming the opposing end of conductive element 23, with conductive element 23 providing electrical continuity between respective counterbores. When cable $C^2$ is inserted into socket assembly 11, the exposed portion of center conductor $E^2$ passes through insulating guide ring 21 and is brought into contact with slotted counterbore $CB^1$. When plug assembly 10 is mated to socket assembly 11, the exposed portion of center conductor $E^1$ passes through insulating guide ring 22 and is brought into contact with slotted counterbore $CB^2$. This arrangement provides the electrical connection between the center conductors of cable $C^1$ and cable $C^2$. The insulating material forming dielectric support 24 maintains the conductive element 23 with its slotted counterbores $CB^1$ and $CB^2$ centrally within and electrically insulated from conductive sleeve 16.

In order to assemble the plug and socket assemblies (10 and 11 respectively) onto their respective cables ($C^1$ and $C^2$ respectively), each cable is prepared as earlier described and inserted into the inner and outer sleeves of the respective plug and socket assembly (18 and 19 for cable C1 and plug assembly 10; and 43 and 44 for cable C2 and socket assembly 11). Outer sleeves 19 and 44 are then compressed radially inward to effect sealed engagement of each cable to its respective plug and socket assembly. Thereafter, the plug assembly is inserted in a snap-fit relation into socket assembly 11 with center conductor $E^1$ extending through insulating guide ring 22 and coming into contact with slotted counterbore $CB^2$, and with tapered cone 33 coming into contact with counterbore 25 via compressible conductive element 40 to complete the electrical connection between cables $C^1$ and $C^2$. In this relation, an inner continuous conductive path is established between the conductor $E^1$, slotted counterbore $CB^2$, conductive element 23, slotted counterbore $CB^1$, and conductor $E^2$; and an outer conductive path is established between the outer conductor $B^1$ via inner sleeve 18, conductive sleeve 12, tapered cone 33, compressible conductive element 40, tapered counterbore 25, conductive sleeve 16, inner sleeve 43 and outer conductor $B^2$. The conductive paths as described are insulated from one another by the dielectric material of the cables ($D^1$ and $D^2$) and dielectric support 24.

DETAILED DESCRIPTION OF MODIFIED FORM OF INVENTION

Figure 6:
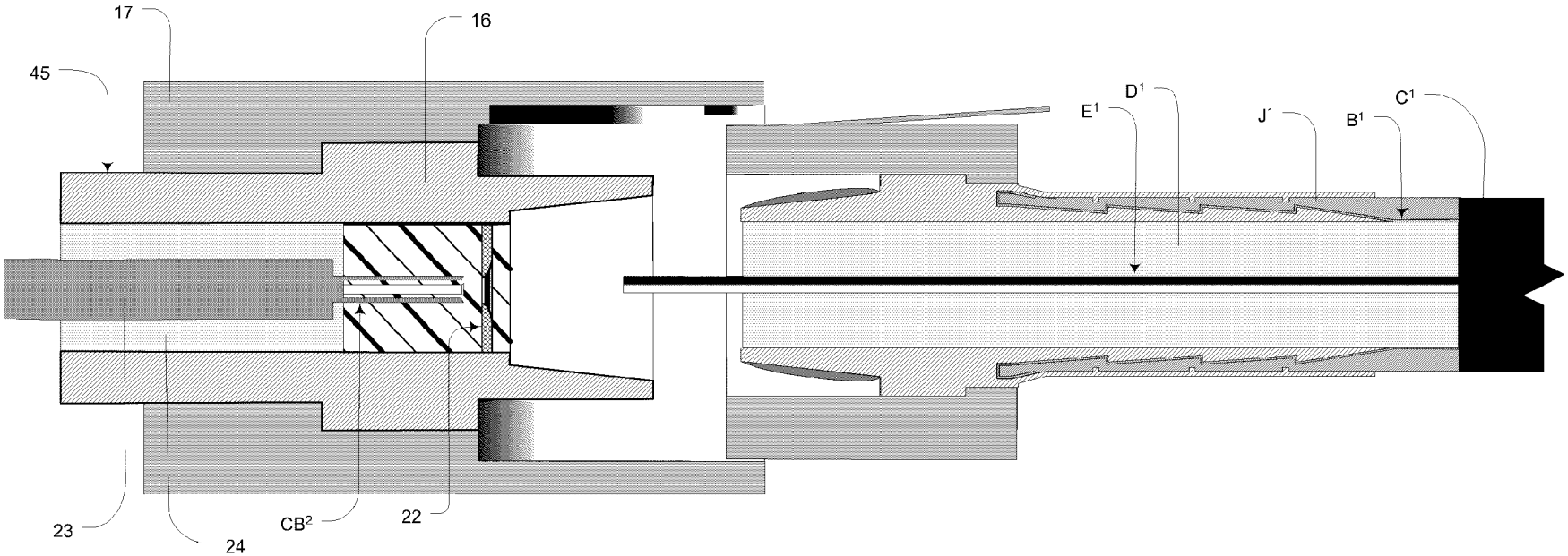
FIG. 6 is a longitudinal sectional view of a modified form of the invention for connecting a coaxial cable to terminal, or other equipment, wherein the socket is configured to provide points of access to the inner and outer conductors for connection to the electrical circuitry of the terminal equipment.

FIG. 6 illustrates another form of socket assembly 11 that is designed for use in connecting a cable to a terminal device or other electronic equipment in a novel and improved manner. For example, coaxial cable $C^1$ may extend from a wall plate or other equipment with a plug assembly of the type described in the preferred form of the invention attached thereto, and conductive paths must be established between inner conductor $E^1$ and outer conductor $B^1$ of cable $C^1$ and presented within the terminal device or equipment for connection to the circuitry contained therein. To this end, a modified form of socket assembly 11 comprises a socket body 17 and socket conductive element 16 corresponding to the form shown in FIG. 6. In this modified form, cylindrical element 45 is lengthened such that it extends beyond socket body 17. In similar manner, conductive element 23 is extended in length such that it extends past the extended end of cylindrical element 45. Insulating material is used to form dielectric support 24 that insulates conductive element 23 from cylindrical element 45, and supports conductive element 23 within the central bore of socket conductive element 16 to the rearward most extension of cylindrical element 45. The extended portions of cylindrical element 45 and conductive element 23' are then available for electrical connection to the circuitry of a terminal device or other equipment.

With this modified form of socket assembly 11, cable C1 with plug assembly 10 attached thereto as shown in FIG. 6, may be connected to the terminal device, and electrical/mechanical connections established through socket assembly 11 to the circuitry of the terminal device or equipment. The plug assembly is inserted in a snap-fit relation into socket assembly 11 with center conductor $E^1$ extending through insulating guide ring 22 and coming into engagement with slotted counterbore $CB^2$, and with tapered cone 33 coming into contact with counterbore 25 though compressible conductive element 40 to complete the electrical connection between cable $C^1$, and the extended portions of cylindrical element 45 and conductive element 23 which are available for connection to the circuitry of the terminal. In this relation, an inner continuous conductive path is established between the conductor $E^1$, slotted counterbore $CB^2$ and extended conductive element 23; and an outer conductive path is established between the outer conductor $B^1$ via inner sleeve 18, conductive element 12, tapered cone 33, compressible conductive element 40, tapered counterbore 25, conductive sleeve 16 and the extended portions of cylindrical element 45.

DETAILED DESCRIPTION OF SECOND MODIFIED FORM OF INVENTION

Figure 7:
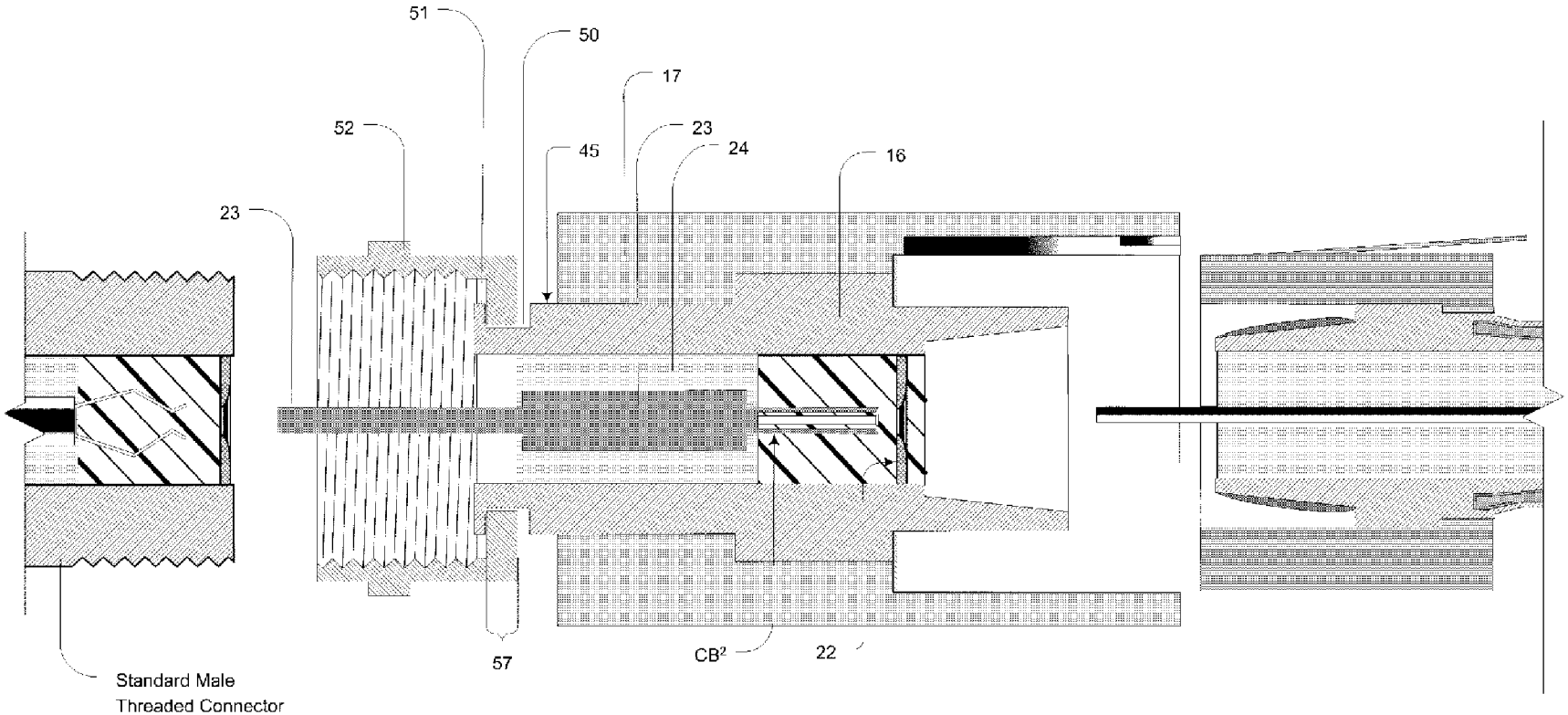
FIG. 7 is a longitudinal sectional view of a modified form of the invention for adapting a standard male threaded connector to a socket connector to receive a cable having a complimentary plug assembly, wherein the socket is configured to provide points of access to the inner and outer conductors for connection to the electrical circuitry of the terminal equipment and wherein the improved center conductive element is depicted.

FIG. 7 illustrates another form of socket assembly 11, which is designed for use in adapting a terminal device, or other equipment fitted with a standard male threaded connector for use with the plug assembly described in the preferred form of the invention. For example, coaxial cable $C^1$ may extend from a wall plate or other equipment with a plug assembly of the type described in the preferred form of the invention attached thereto, and conductive paths must be established between inner conductor $E^1$ and outer conductor $B^1$ of cable $C^1$ and presented within the terminal device or equipment connecting through a standard male threaded connector. To this end, a modified form of socket assembly 11 comprises a socket body 17 and socket conductive element 16 corresponding to the form shown in FIG. 7. In this modified form, cylindrical element 45 is lengthened such that it extends beyond socket body 17, reducing in diameter external to socket body 17 as depicted at 50, and then increasing in diameter to form flange 51. Threaded nut 52 is formed with lip 57 such that lip 57 in conjunction with flange 51 retains threaded nut 52 to socket conductive element 16. In similar manner, conductive element 23 is extended in length such that it protrudes past the extended end of cylindrical element 45 and beyond threaded nut 52. Insulating material is used to form dielectric support 24 that insulates conductive element 23 from cylindrical element 45, and supports conductive element 23 within the central bore of socket conductive sleeve 16 to the rearward most extension of cylindrical element 45. Conductive element 23 is sized at all points to match the characteristic impedance of the coaxial cable in use considering the dielectric properties of the surrounding material, if any, the diameter of the corresponding shield and any other factors present that impact the characteristic impedance of conductors. The extended portion of cylindrical element 45, through contact established with threaded nut 52, and the extended portion of conductive element 23' are then available for electrical connection to the complementary elements of a standard male threaded connector, and through said male terminal connector to the circuitry of a terminal device or other equipment.

With this modified form of socket assembly 11, the extended portion of conductive element 23 is inserted into the central opening of a standard male threaded connector until threaded nut 52 contacts the threaded portion of the standard male threaded connector. As threaded nut 52 engages and is tightened upon the threads of the male threaded connector, conductive element 23 is drawn into the male threaded connector establishing contact with the center conductive elements thereof. Threaded nut 52, in combination with cylindrical element 45 establish a connection with the outer shield of the male threaded connector through the complementary and engaged threaded portions of the male threaded connector and threaded nut 52.

Now a cable or other device with plug assembly 10 attached thereto, may be connected to the terminal or other device equipped with a male threaded connector, and electrical/mechanical connections established through socket assembly 11 to the threaded male terminal connector and thence to the circuitry of the terminal device or equipment. The plug assembly is inserted in a snap-fit relation into socket assembly 11 with center conductor $E^1$ extending through insulating guide ring 22 and coming into engagement with slotted counterbore $CB^2$, and with tapered cone 33 coming into contact with counterbore 25 though compressible conductive element 40 to complete the electrical connection between cable $C^1$, and the extended portions of cylindrical element 45 and conductive element 23, making contact with the male terminal connector through threaded nut 52 and insertion of conductive 23 into the central opening of the threaded male terminal connector. In this relation, an inner continuous conductive path is established between the conductor $E^1$, slotted counterbore $CB^2$ and extended conductive element 23; and an outer conductive path is established between the outer conductor $B^1$ via conductive sleeve 12, tapered cone 33, compressible conductive element 40, tapered counterbore 25, conductive sleeve 16, the extended portions of cylindrical element 45 and threaded nut 52, to the respective inner and outer conductors of the standard male threaded connector.

DETAILED DESCRIPTION OF THIRD MODIFIED FORM OF INVENTION

Figure 8:
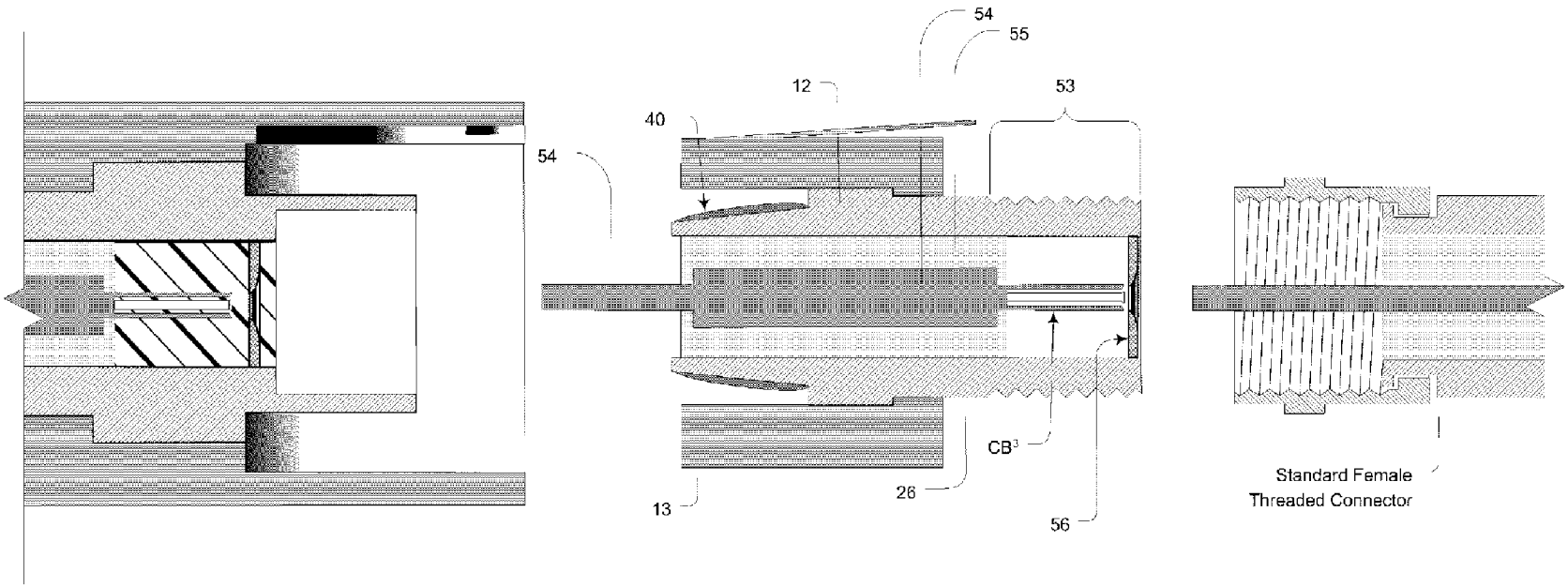
FIG. 8 is a longitudinal sectional view of a modified form of the invention for adapting a standard, threadedly mated female connector, as used on cables, to a plug assembly ready for mating with a socket assembly.

FIG. 8 illustrates another form of plug assembly 10, which is designed for use in adapting a cable, or other electronic equipment equipped with a standard female threaded connector for use with the socket assembly described in the preferred and modified forms of the invention. For example, a cable, terminal device or other electronic equipment may be fitted with a socket assembly as described in the preferred and modified forms of the invention as depicted in FIGS. 1, 4*a*, 6 and 7, and a cable or other device fitted with a standard female threaded connector, requires connection to said equipment such that conductive paths must be established between inner conductor and the outer conductor of standard female threaded connector and presented to the socket assembly. To this end, a modified form of plug assembly 10 comprises a plug body 17 and plug conductive element 12 corresponding to the form shown in FIG. 8. In this modified form, cylindrical element 26 is lengthened such that it extends beyond plug body 13, and having external threads 53 sufficient for engaging the complementary threads of a standard threaded female connector. In this modified plug assembly, conductive element 12 is fitted with conductive components similar to those found in the second modified form of the socket assembly of the invention element, which components are fitted into the central opening of plug conductive element 12. The conductive components located within plug conductive element 12 are comprised of conductive element 54 that extends beyond tapered conductive cone 33 with sufficient length for connecting physically and electrically to the center conductive elements of a receiving socket assembly. The opposing end of conductive element 54 is fitted with a slotted counterbore $CB^3$ for receiving the center conductor of the standard threaded female connector. Insulating material is used to form dielectric support 55 that insulates conductive element 54 from conductive element 12 throughout its length, and supports conductive element 23 within the central bore thereof as shown. Conductive element 23 is sized at all points to match the characteristic impedance of the coaxial cable in use considering the dielectric properties of the surrounding material, if any, the diameter of the corresponding shield and any other factors present that impact the characteristic impedance of conductors. The end of the extended portion of cylindrical element 26 is fitted with insulating guide ring 56 located within the central opening of plug conductive sleeve 12.

With this modified form of plug assembly 10, the center conductor from a standard female threaded connector is inserted through insulating guide ring 56 until the threaded nut of the threaded female connector contacts the threaded end 53 of cylindrical element 26. By engaging, rotating and tightening the threaded nut of the standard female connector upon threaded end 53, the center conductor of said connector is drawn fully into mechanical and electrical engagement with slotted counterbore $CB^3$ and conductive element 54. The threaded nut of the standard threaded female connector, in combination with threaded end 54 establishes a connection between the outer shield of the cable or other equipment and plug conductive sleeve 12.

Now a cable or other equipment fitted with a standard threaded female connector may be connected to a cable or other device equipped with a socket assembly as described in preferred and modified forms of the invention, and electrical/mechanical connections established through the modified plug assembly to a socket assembly and thence to the cable, terminal device or other equipment connected to said socket assembly. This modified plug assembly is inserted in a snap-fit relation into socket assembly 11 with the extended portion of conductive element 54 passing through insulating guide ring 22 and coming into engagement with slotted counterbore $CB^2$, and with tapered cone 33 coming into contact with counterbore 25 though compressible conductive element 40 to complete the electrical connection for the inner and outer conductors respectively. In this relation, an inner continuous conductive path is established between the center conductor of the standard female threaded connector, slotted counterbore $CB^3$, extended conductive element 54 and counterbore $CB^2$; and an outer conductive path is established between the outer conductor of the standard female threaded connector via conductive sleeve 12, tapered cone 33, compressible conductive element 40, tapered counterbore 25 and conductive sleeve 16 to the respective inner and outer conductors of the cable, terminal or equipment equipped with socket assembly 11.

It is therefore to be understood that while preferred and modified forms of invention are herein set forth and described, various modifications and changes may be made in the construction and arrangement of parts as well as composition of materials without departing from the spirit and scope of the present invention as defined by the appended claims.

What is claimed is:

1. A modular connector assembly for connecting coaxial cable together wherein said cable has radially inner and outer conductors separated by an annular dielectric, in some cases a tubular jacket encasing said outer conductor and a portion of said inner conductor being exposed at the end of said cable, said assembly comprising:

(a) a plug connector having radially inner and outer spaced coaxial sleeves, said inner sleeve being sized for insertion of said inner conductor and said annular dielectric therein, said outer sleeve being sized for insertion of said conductor and said jacket, if any, through one end of said connector between said inner and outer sleeves;

(b) said plug connector having a body with at least one locking tab, at least one locking release tab, guide surface(s), a central bore and a central counterbore;

(c) said plug connector having a hollow generally cylindrical portion, a tapered cone at one end of said cylindrical portion and a conductor member extending concentrically within said cylindrical portion;

(d) said cylindrical portion of said plug connector forming the outer conductor of said plug connector;

(e) a socket connector having radially inner and outer spaced coaxial sleeves, said inner sleeve being sized for insertion of said inner conductor and said annular dielectric therein, said outer sleeve being sized for insertion of said conductor and said jacket, if any, through one end of said connector between said inner and outer sleeves;

(f) said socket connector having a body with guide surfaces, mating cavity, at least one locking cavity, at least one locking tab release slot, a central bore and a central counterbore;

(g) said socket connector having a hollow generally cylindrical portion, a tapered counterbore at one end of said cylindrical portion and a central conductive member with central counterbores at opposing ends thereof and said conductive element placed concentrically within said cylindrical portion;

(h) said cylindrical portion of said socket connector forming the outer conductor of said socket connector;

(i) said central conductive member of said socket connector forming the inner conductor of said socket connector;

(j) said inner and outer conductors of said plug connector and said socket connector including complementary end portions for positively connecting said inner and outer conductors positively;

(k) whereas the improvement is a compressible conductive element placed between the tapered cone of said plug connector and the tapered counterbore of said socket assembly forming part of the outer conductor of said plug assembly and said socket assembly;

(l) said cylindrical portion of said plug connector being fixed within said plug body;

(m) said cylindrical portion of said socket connector being fixed within said socket body; and (n) said central conductive member of said socket connecter having central counterbores at opposing ends thereof.

2. A connector assembly according to claim 1, said plug assembly directly connecting to a coaxial cable and said socket assembly directly connecting to a coaxial cable.

3. A connector assembly according to claim 1, said plug connecting end portion and said socket connecting end portion having complementary mating cavities and guide surfaces.

4. A connector assembly according to claim 1, wherein a compressible conductive element is employed in either the plug assembly or the socket assembly, said compressible conductive element being employed to maintain electrical and mechanical connection between the outer conductors of said plug assembly and said socket assembly.

5. A connector assembly according to claim 1, wherein said plug assembly and said socket assembly each employ a cylindrical conductive sleeve, wherein the conductive sleeve of said plug assembly or said socket assembly is generally fixed within its respective plug or socket body.

6. A terminal connector assembly for connecting an end of a coaxial cable or other device to a terminal wherein said cable has radially inner and outer conductors separated by an annular dielectric, in some cases a tubular jacket encasing said outer conductor and a portion of said inner conductor being exposed at the end of said cable, said assembly comprising:

(a) a plug connector having radially inner and outer spaced coaxial sleeves, said inner sleeve being sized for insertion of said inner conductor and said annular dielectric therein, said outer sleeve being sized for insertion of said conductor and said jacket through one end of said connector between said inner and outer sleeves;

(b) said plug connector having a body with at least one locking tab, at least one locking release tab, guide surface(s), a central bore and a central counterbore;

(c) said plug connector having a hollow generally cylindrical portion, a tapered cone at one end of said cylindrical portion and a conductor member extending concentrically within said cylindrical portion;

(d) said cylindrical portion of said plug connector forming the outer conductor of said plug connector;

(e) said socket connector having a body with guide surface(s), mating cavity, at least one locking cavity, at least one locking tab release slot, a central bore and a central counterbore;

(g) said socket connector having a hollow generally cylindrical portion, a tapered counterbore at one end of said cylindrical portion and a central conductive member with a counterbore at one end, said conductive element placed concentrically within said cylindrical portion;

(h) said central conductive member extending through said socket body such that electrical connection may be made to said central conductor within a terminal device;

(i) said cylindrical portion of said socket connector forming the outer conductor of said socket connector;

(j) said central conductor of said socket connector extending through said socket body such that electrical connection may be made to said central conductor within a terminal device;

(k) said inner and outer conductors of said plug connector and said socket connector including complementary end portions for positively connecting said inner and outer conductors positively;

(l) whereas the improvement is a compressible conductive element placed between the tapered cone of said plug connector and the tapered counterbore of said socket assembly forming part of the outer conductor of said plug assembly and said socket assembly; and (m) said central conductive member of said socket connector having central counterbores at opposing ends thereof.

7. A connector assembly for adapting a standard male threaded connector to a socket assembly for connecting an end of a coaxial cable or other device to a device wherein said cable or other device is equipped with a plug assembly wherein said cable or other device has radially inner and outer conductors separated by an annular dielectric, in some cases a tubular jacket encasing said outer conductor and a portion of said inner conductor being exposed at the end of said cable, said assembly comprising:

(a) a plug connector having radially inner and outer spaced coaxial sleeves, said inner sleeve being sized for insertion of said inner conductor and said annular dielectric therein, said outer sleeve being sized for insertion of said conductor and said jacket, if any, through one end of said connector between said inner and outer sleeves;

(b) said plug connector having a body with at least one locking tab, at least one locking release tab, guide surface(s), a central bore and a central counterbore;

(c) said plug connector having a hollow generally cylindrical portion, a tapered cone at one end of said cylindrical portion and a conductor member extending concentrically within said cylindrical portion;

(d) said cylindrical portion of said plug connector forming the outer conductor of said plug connector;

(e) said socket connector having a body with guide surface(s), mating cavity, at least one locking cavity, at least one locking tab release slot, a central bore and a central counterbore;

(g) said socket connector having a hollow generally cylindrical portion, a tapered counterbore at one end of said cylindrical portion and a flange at the opposing end thereof to retain a threaded nut thereto, and a central conductive member with a counterbore at one end and an extended pin at the opposing end thereof, said conductive element placed concentrically within said cylindrical portion;

(h) said central conductive member extending through said threaded nut such that electrical connection may be made to the center conductor of said standard male threaded connector;

(i) said cylindrical portion and sail threaded nut of said socket connector forming the outer conductor of said socket connector;

(j) said outer conductor of said socket connector extending through said socket body such that electrical connection may be made to said outer conductor of said standard male threaded connector;

(k) said inner and outer conductors of said plug connector and said socket connector including complementary end portions for positively connecting said inner and outer conductors positively; and (l) a compressible conductive element placed between the tapered cone of said plug connector and the tapered counterbore of said socket assembly forming part of the outer conductor of said plug assembly and said socket assembly.

8. A connector assembly for adapting a standard female threaded connector to a plug assembly for connecting an end of a coaxial cable or other device to a device wherein said device is equipped with a socket assembly wherein said device has radially inner and outer conductors separated by an annular dielectric, in some cases a tubular jacket encasing said outer conductor and a portion of said inner conductor being exposed at the end of said device, said assembly comprising:

(a) a plug connector having a body with at least one locking tab, at least one locking release tab, guide surfaces, a central bore and a central counterbore;

(b) said plug connector having a hollow generally cylindrical portion, a tapered cone at one end of said cylindrical portion and external threads on the opposing end thereof, a central conductive member with a counterbore at one end and an extended pin at the opposing end thereof, said conductive element placed concentrically within said cylindrical portion;

(c) said cylindrical portion of said plug connector forming the outer conductor of said plug connector;

(d) said central conductive member of said socket connector forming the inner conductor of said plug connector;

(e) said socket connector having a body with guide surfaces, mating cavity, at least one locking cavity, at least one locking tab release slot, a central bore and a central counterbore;

(g) said socket connector having a hollow generally cylindrical portion, a tapered counterbore at one end of said cylindrical portion, and a central conductive member with a counterbore at one or both ends, said conductive element placed concentrically within said cylindrical portion;

(h) said central conductive member of said socket connector forming the outer conductor of said socket connector said central conductive member extending through said cylindrical portion such that electrical connection may be made to the center conductor of said cable or device;

(i) said cylindrical portion of said socket connector forming the outer conductor of said socket connector;

(j) said outer conductor of said socket connector extending through said socket body such that electrical connection may be made to said outer conductor of said cable or device;

(k) said inner and outer conductors of said plug connector and said socket connector including complementary end portions for positively connecting said inner and outer conductors positively; and (l) a compressible conductive element placed between the tapered cone of said plug connector and the tapered counterbore of said socket assembly forming part of the outer conductor of said plug assembly and said socket assembly.

* * * * *